US007013080B1

(12) United States Patent
Kaplanis et al.

(10) Patent No.: US 7,013,080 B1
(45) Date of Patent: *Mar. 14, 2006

(54) SPACE HEATER WITH AREA LIGHT SOURCE

(75) Inventors: Kostas Kaplanis, Urbana, OH (US); Charles M. Wagner, Urbana, OH (US)

(73) Assignee: The W. B. Marvin Manufacturing Company, Urbana, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/760,124

(22) Filed: Jan. 16, 2004

Related U.S. Application Data

(63) Continuation of application No. 10/217,154, filed on Aug. 12, 2002, now abandoned.

(60) Provisional application No. 60/312,013, filed on Aug. 13, 2001.

(51) Int. Cl.
*H05B 3/00* (2006.01)
*F24D 13/00* (2006.01)

(52) U.S. Cl. ..... 392/422; 392/376; 219/220; 362/92

(58) Field of Classification Search ..... 392/422, 392/376, 360–369, 423, 430; 219/220; 362/92, 253
See application file for complete search history.

(56) References Cited

U.S. PATENT DOCUMENTS

| | | | |
|---|---|---|---|
| 893,994 | A | 7/1908 | Green |
| 1,579,513 | A | 4/1926 | Cameron |
| 1,660,802 | A | 2/1928 | Martin |
| 2,133,188 | A | 10/1938 | Conforti |
| 2,361,414 | A | 10/1944 | Ramsey |
| 2,372,832 | A | 4/1945 | Jepson |
| 2,445,250 | A | 7/1948 | Steingruber |
| 2,452,210 | A | 10/1948 | Rogers |
| 2,495,513 | A | 1/1950 | Doyle |
| 2,678,372 | A | 5/1954 | Salton |
| 2,870,319 | A | 1/1959 | Ford |
| 3,001,056 | A | 9/1961 | Spear |
| 3,005,081 | A | 10/1961 | Kordes et al. |
| 3,028,475 | A | 4/1962 | Nash |
| 3,059,090 | A | 10/1962 | Waters |
| 3,275,814 | A | 9/1966 | Meyer |
| 3,309,502 | A | 3/1967 | Witherspoon, Jr. |
| 3,322,946 | A | 5/1967 | Cooper |
| 3,785,271 | A | 1/1974 | Joy |
| 3,786,575 | A | 1/1974 | Riblett |
| 3,909,589 | A | 9/1975 | Stone et al. |
| 4,004,128 | A | 1/1977 | Marchesi |
| 4,263,500 | A | 4/1981 | Springer et al. |
| 4,681,024 | A | 7/1987 | Ivey |
| 4,760,243 | A | 7/1988 | Tedioli |
| 5,091,835 | A | 2/1992 | Malek et al. |
| 5,287,253 | A | 2/1994 | Blorstad |
| 5,381,509 | A | 1/1995 | Mills |

(Continued)

OTHER PUBLICATIONS

Instruction Manual for Marvin 7530 "Quartz Halogen Heater" published by The W. B. Marvin Manufacturing Company, Urbana, Ohio, during 1995.

(Continued)

*Primary Examiner*—John A. Jeffery
(74) *Attorney, Agent, or Firm*—Roger S. Dybvig

(57) ABSTRACT

A radiant electric space heater is provided with a halogen light source which provides light to the same general area to which radiant electric energy is transmitted by the heating elements. The halogen light source is located behind a grill that covers a window located at the front of the heater.

2 Claims, 2 Drawing Sheets

U.S. PATENT DOCUMENTS

| | | | | |
|---|---|---|---|---|
| 5,621,846 | A | 4/1997 | Smith et al. | |
| 5,713,343 | A | 2/1998 | Taylor et al. | |
| 5,922,227 | A | 7/1999 | McMurtrie | |
| 5,984,490 | A | 11/1999 | Leen | |
| 6,091,888 | A | 7/2000 | Jane et al. | |
| 6,122,437 | A | 9/2000 | Johnson | |
| 6,167,196 | A | 12/2000 | Huggins, Jr. et al. | |
| 6,248,979 | B1 | 6/2001 | Cafaro | |
| 6,810,205 | B1 * | 10/2004 | Kaplanis et al. | 392/422 |

OTHER PUBLICATIONS

The Marvin 7530 Quartz Halogen Heater to which the Reference AR Instruction Manual is directed was marketed in the United States by applicants' assignee beginning during 1995.

Copending utility U.S. Appl. No. 10/358,076 of Kostas Kaplanis et al., filed Feb. 3, 2003.

* cited by examiner

FIG-1
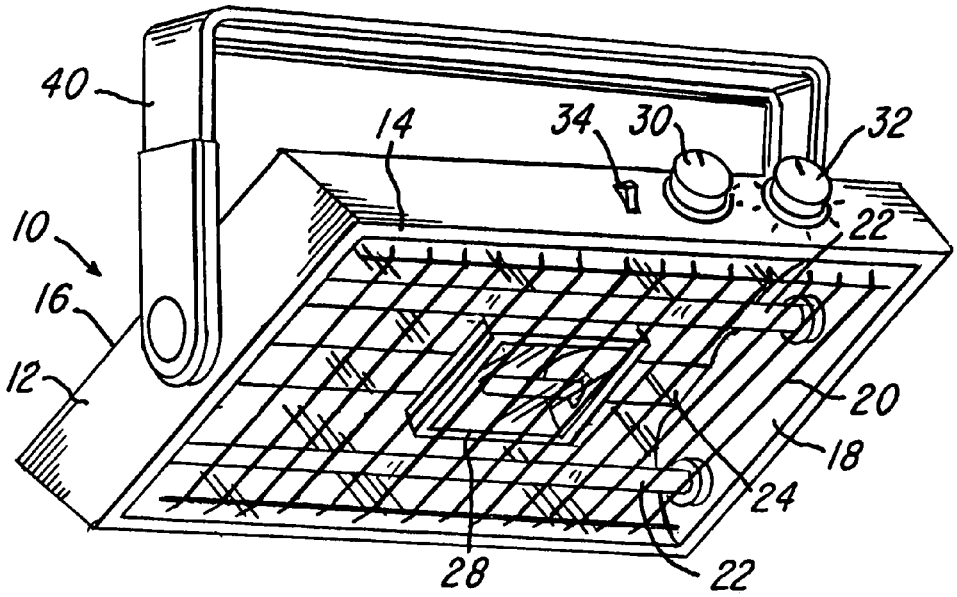
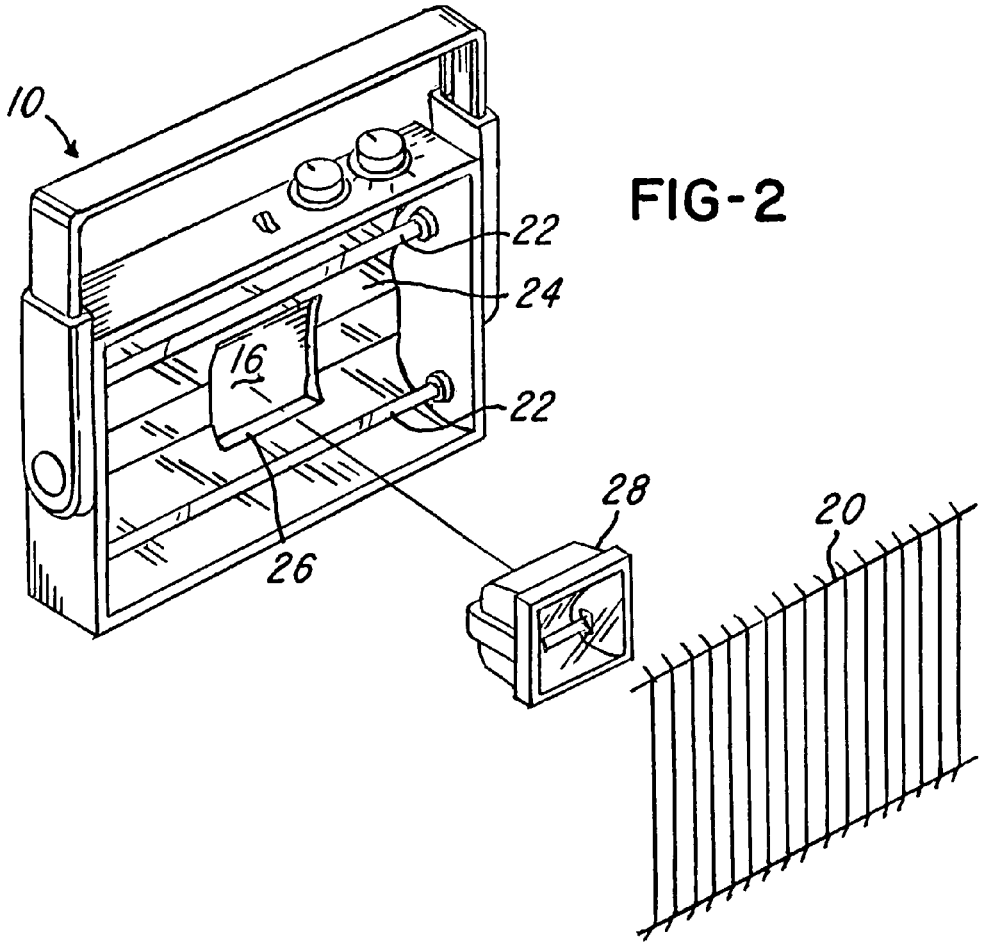
FIG-2

SPACE HEATER WITH AREA LIGHT SOURCE

CROSS-REFERENCE TO RELATED APPLICATIONS

This application is a continuation of U.S. application Ser. No. 10/217,154, filed Aug. 12, 2002, now abandoned, which claims the benefit of U.S. Provisional Application No. 60/312,013, filed Aug. 13, 2001.

FIELD OF THE INVENTION

This invention relates to electric space heaters.

INCORPORATION BY REFERENCE

The disclosures of U.S. Pat. Nos. 5,621,846 and 6,122,437, are hereby incorporated by reference herein.

BACKGROUND OF THE INVENTION

Electric space heaters are in common use. Many such space heaters are portable. Some portable space heaters have mounting brackets by which they may be mounted on fixed surfaces, such as ceilings, or on movable supports, such as tripods. Space heaters are typically limited to the provision of heat to an area or to objects within an area. Some space heaters are primarily radiant heaters which heat objects within an area but contribute insignificant amounts of heat to the area by convection or conduction. Other space heaters are primarily convective heaters which have fans that blow heated air into an area. Both such types of space heaters are primarily useful only for providing heat to an area.

SUMMARY OF THE INVENTION

In accordance with this invention, a space heater has an area light source which can be used to provide light to the same general area which is heated by the heater. The light source may be operable whether or not the heater is being operated to provide heat to the area.

The light source can be mounted in the heater and directed generally to the same area to which heat produced by the space heater is directed. With such enhancement, the heater will be useful whenever desired to add warmth to those in the area of the heater and will also be useful whenever desired to provide light to those in the area of the heater.

The invention may be used with either permanently mounted or portable space heaters. In a highly useful application of this invention, a workplace heater with a light source also includes a mounting assembly for removably mounting the heater housing on a support.

Other objects and advantages will become apparent from the following description and the drawings.

BRIEF DESCRIPTION OF THE DRAWINGS

FIG. 1 is a perspective view of a space heater provided with an area light source in accordance with this invention.

FIG. 2 is exploded perspective view of the heater of FIG. 1.

DETAILED DESCRIPTION

Figure 3:
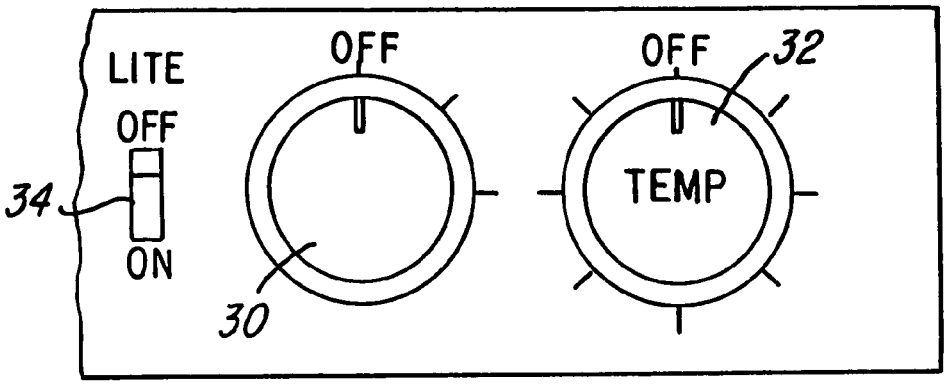
FIG. 3 is a fragmentary plan view of a control panel of the heater of FIG. 1.

FIGS. 1 and 2 illustrate a space heater 10 of the type known as a workplace or workshop heater and is of the type illustrated in aforementioned U.S. Pat. Nos. 5,621,846 and 6,122,437. The heater 10 has a housing 12 with a front wall 14 and a rear wall 16. The front wall 14 is open to provide a window 18 covered by a grill 20 for the passage of radiant heat there through. The radiant heat is generated by a pair of heating elements 22 mounted in front of a reflector 24. The construction of the heater 10 as thus far described can be essentially the same as the corresponding parts of the heater shown in U.S. Pat. No. 5,621,846.

In accordance with the present invention, the reflector 24 has an opening 26 for receiving an area light source 28 which can be mounted in any suitable manner in the housing 12 behind the grill 20. For example, the light source 28 can be affixed to the housing rear wall 16 or to a mounting plate (not shown) connected to the rear wall 16. A light source suitable for the practice of the present invention is a commercially available halogen light source which is provided with its own housing, reflector and glass front piece.

With reference also to FIG. 3, the heater 10 may be provided with a first, heater control knob 30 which has an "off" position and two "on" positions, one for energizing only one of the heating elements 22 and the other for energizing both heating elements 22. A second, temperature control knob 32 controls a thermostatic switch (not shown) that controls the intervals of time during which the heating elements are operable. In addition, a separate off-on switch 34 is used to control the operation of the light source 28.

Figure 4:
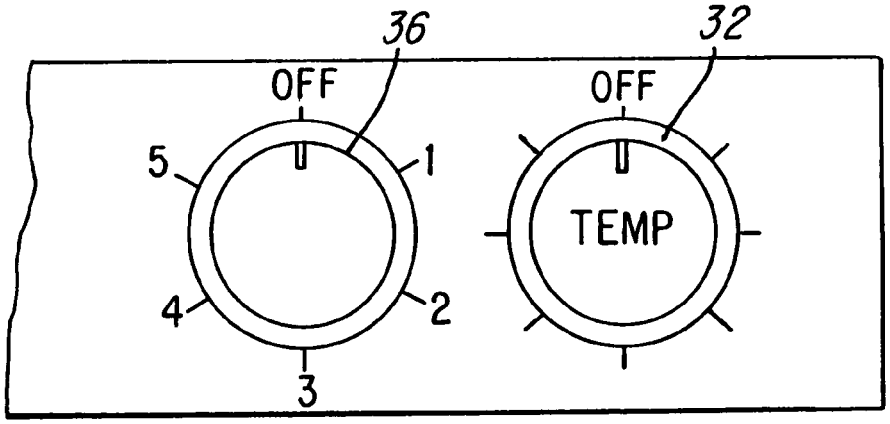
FIG. 4 is a fragmentary plan view of a modified control panel for a heater in accordance with this invention.

FIG. 4 shows a modification in which the first, heater control knob 30 of FIG. 3 is replaced by a heater/light control knob 36 that has multiple positions. The precise number of useful positions of the heater/light control knob 36 can be determined by the manufacturer of a space heater in accordance with this invention. The illustrated knob 36 has six positions as follows:

Off
1. Light source only energized
2. Light source and one heating element energized
3. Light source and both heating elements energized
4. One heating element only energized
5. Both heating elements only energized As evident, other different switch arrangements could be employed.

The electric circuitry for delivering power to the heating elements and the light source can be a simple circuit that utilizes the same electric power source for energizing both the heating elements and the light source.

Referring again to FIGS. 1 and 2, a mounting bracket 40 is pivotally mounted to the housing 12 by which the heater 10 can be suspended from a ceiling, mounted on an underlying support, such as a tripod (not shown), or otherwise removably mounted on a suitable support.

We claim:

1. A space heater comprising:

a housing;

a window in the front of the housing;

a grill covering at least part of the window;

a reflector behind the grill;

at least one radiant heating element located between the reflector and the grill for transmitting radiant energy to a general area in front of the heater; and a halogen light source separate from said at least one radiant heating element, said light source supported within the housing behind the grill and including a glass plate located between the reflector and the grill for providing light to the same general area.

2. A space heater comprising:

a housing;

a window in the front of the housing;

a grill covering at least part of the window;

a reflector behind the grill;

at least one radiant heating element located between the reflector and the grill for transmitting radiant energy to a general area in front of the heater;

a halogen light source supported within the housing behind the grill including a glass plate located between the reflector and the grill for providing light to the same general area; and an electric circuit with an electric switch construction that enables energization of the at least one heating element and the halogen light source separately or simultaneously.

* * * * *